US008893915B2

(12) United States Patent
Vargas

(10) Patent No.: US 8,893,915 B2
(45) Date of Patent: Nov. 25, 2014

(54) CONTAINER WITH REMOVABLE DIVIDERS

(71) Applicant: Jhon Alexander Vargas, Renton, WA (US)

(72) Inventor: Jhon Alexander Vargas, Renton, WA (US)

( * ) Notice: Subject to any disclaimer, the term of this patent is extended or adjusted under 35 U.S.C. 154(b) by 0 days.

(21) Appl. No.: 14/024,365

(22) Filed: Sep. 11, 2013

(65) Prior Publication Data

US 2014/0238995 A1 Aug. 28, 2014

Related U.S. Application Data

(60) Provisional application No. 61/769,023, filed on Feb. 25, 2013.

(51) Int. Cl.
*B65D 25/08* (2006.01)
*B65D 25/04* (2006.01)

(52) U.S. Cl.
CPC ..... *B65D 25/08* (2013.01); *B65D 25/04* (2013.01)
USPC ..... 220/549; 220/544

(58) Field of Classification Search
CPC ..... B65D 1/36; B65D 7/065; B65D 25/06; B65D 25/04; B65D 2501/24; B65D 1/24
USPC ..... 220/526, 523, 549, 544, 532, 534, 529
See application file for complete search history.

(56) References Cited

U.S. PATENT DOCUMENTS

| | | | | | |
|---|---|---|---|---|---|
| 2,125,856 | A * | 8/1938 | De Witt | 220/532 |
| 3,656,650 | A * | 4/1972 | Frater | 220/533 |
| 4,360,105 | A * | 11/1982 | Williams | 206/544 |
| 4,577,773 | A * | 3/1986 | Bitel | 220/533 |
| 4,593,816 | A * | 6/1986 | Langenbeck | 206/425 |
| 4,838,445 | A * | 6/1989 | Lanius | 220/533 |
| 5,390,815 | A * | 2/1995 | Spiegel | 220/529 |
| 5,547,098 | A * | 8/1996 | Jordan | 220/23.86 |
| 5,806,708 | A * | 9/1998 | Schwab | 220/552 |
| 6,467,647 | B1 * | 10/2002 | Tucker et al. | 220/793 |
| D555,475 | S * | 11/2007 | Enriquez et al. | D9/737 |
| 8,322,530 | B2 * | 12/2012 | Furlong | 206/508 |
| 8,328,034 | B2 * | 12/2012 | Miros et al. | 220/4.22 |
| 2002/0096525 | A1 * | 7/2002 | Bertoldo et al. | 220/544 |
| 2008/0128428 | A1 * | 6/2008 | Beckerman | 220/532 |

FOREIGN PATENT DOCUMENTS

| | | | | |
|---|---|---|---|---|
| DE | 4433680 | A1 * | 3/1996 | B65D 25/04 |
| EP | 652159 | A1 * | 5/1995 | B65D 25/06 |
| GB | 1027403 | A * | 4/1966 | B65D 25/04 |
| JP | 2005082206 | A * | 3/2005 | B65D 25/06 |

OTHER PUBLICATIONS

Translation of DE4433680 (Morszeck), Mar. 28, 1996, p. 2.*

* cited by examiner

*Primary Examiner* — Robert J Hicks
(74) *Attorney, Agent, or Firm* — The Olmsted Law Group, PLLC

(57) ABSTRACT

A storage system is provided comprising a container, lid and removable dividers with rubberized edges. The container features at least one track into which corresponding removable dividers with rubberized edges are inserted and held in place. The removable dividers of the system are inserted into the track(s) of the container and form a watertight seals and separate the container into two or more sections. The lid of the system is secured to the container with a threaded or pressure snap attachment mechanism and forms a watertight seal.

3 Claims, 8 Drawing Sheets

CONTAINER WITH REMOVABLE DIVIDERS

CROSS-REFERENCE TO RELATED APPLICATIONS

The present application claims priority of the U.S. Provisional Patent Application 61/769,023 filed on Mar. 4, 2013 entitled "Container with Removable Dividers," the contents of which are hereby incorporated by reference.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention relates to storage containers with lids. More particularly, the present invention relates to storage containers with removable partitions allowing compartmentalization.

Traditional storage containers feature either a non-compartmentalized or compartmentalized interior enclosed by a lid for sealing and securing contents. Users often desire to store consumable and non-consumable goods in containers and are forced to use more than one container in order to avoid mixing contents or creating an undesired combination of certain types of contents as a result of having a non-compartmentalized container. Users may find compartmentalized containers are not always ideal, because the storage proportions in fixed-compartment containers do not match the user's requirements. As such, a container that allows users to reconfigure compartment sizes within the storage container is often useful, as it allows for separation of contents while allowing a level of customization not found in fixed compartment containers.

Prior art teaches containers with removable partitions so users can customize compartment sizes. The problem with the containers found in the prior art that feature removable partitions is the partitions do not provide a liquid-proof seal, leading to unwanted transfers of consumables or non-consumables between partitions.

The inventor performed a prior art search for storage containers of interest. The following U.S. patents of interest are:

| U.S. Pat. No.: | Issue Date: | Inventor: |
|---|---|---|
| 4,360,105 | Nov. 23, 1982 | Williams |
| 5,547,098 | Aug. 20, 1996 | Jordan |
| 6,467,647 | Oct. 22, 2002 | Tucker |
| D555,475 | Nov. 20, 2007 | Enriquez |
| 8,322,530 | Dec. 4, 2012 | Furlong |
| 8,328,034 | Dec. 11, 2012 | Miros |

SUMMARY OF THE INVENTION

A storage container with a lid and an interior comprised of tracks and removable dividers that form a watertight seal between compartments so that contents are not inadvertently mixed. The container may be used for consumables and non-consumables in both solid and liquid states. The removable dividers may be arranged within the tracks to modify the sizes of the individual compartments. The lid of the container fits flush with the sides of the container and the seals on the removable dividers to form a leak-proof container.

The removable dividers are inserted into tracks inside the storage container and allow the user to customize the storage configurations within the container. Rubberized edges surround the exterior dimensions of the removable dividers and provide for a leak-proof seal between compartments. The tracks that hold the removable dividers may be designed in such a way as to apply pressure to the removable dividers to seal and further prevent leakage between compartments. The configuration of the removable dividers and tracks may vary in quantity, dimensions, design and shape.

The inventor believes the present invention is an improvement over prior art because it allows a level of customization not found in the prior art. By utilizing removable dividers with leak-proof seals, the present invention improves on prior art by stopping leakages between compartments in customizable storage containers.

DETAILED DESCRIPTION OF THE INVENTION

The system and methods described herein are provided for container assemblies for storing and transporting consumable and non-consumable products. The container assembly generally comprises one or more modifiable compartments and a lid for sealing the contents within the container. The container assembly may include two or more tracks for housing removable dividers with rubberized edges. One or more removable dividers may be used to configure storage compartments in the interior of the container assembly.

Figure 1:
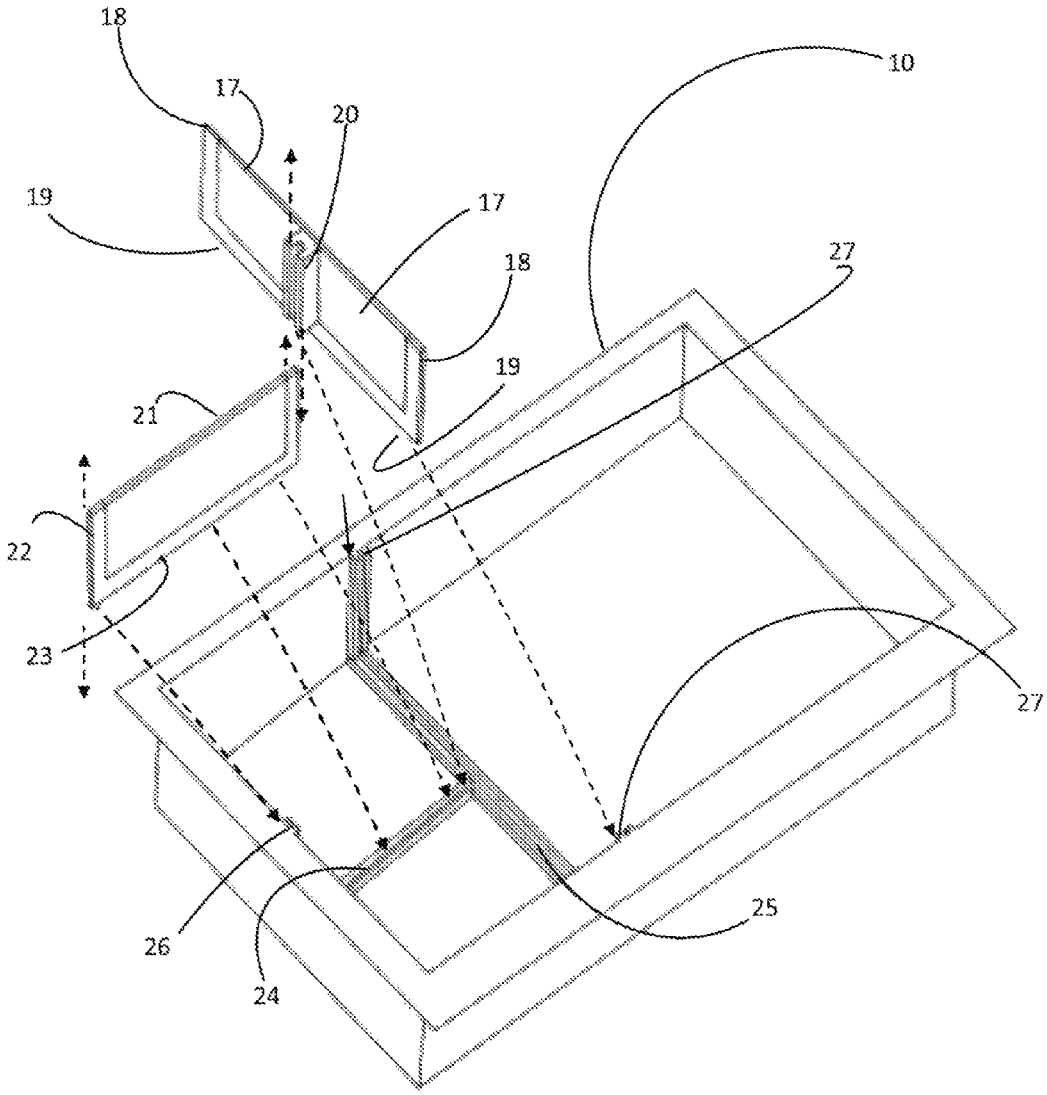
FIG. 1 is a perspective view of the present invention showing the removable dividers and their insertion points in the tracks, according to the preferred embodiment of the present invention.

Referring now to the preferred embodiment of the current invention as shown in FIG. 1, there is shown the container 10 having removable horizontal divider 17 and removable vertical center divider 21 in disengaged mode. The preferred embodiment of the present invention consists of a container 10 with compartmentalization features. Side track channels 27 meet a bottom horizontal track channel 25. A bottom center track channel 24 meets the bottom horizontal track channel 25. A vertical center side track channel 26 meets the bottom center track channel 24. The track channels 24 25 26 27 provide pressure to the removable horizontal divider 17 and removable center divider 21 when they are placed in the tracks to form a watertight seal between the storage chambers.

Still referring to the preferred embodiment of the present invention as shown in FIG. 1, the removable horizontal divider 17 features rubberized side edges 18, a rubberized bottom edge 19 and a vertical track 20, which is configured to join flush with the bottom center track channel 24. The removable horizontal divider 17 slides within the container's vertical center side track channel 26 and horizontal track channel 25 when so desired by the user. The removable center divider 21 features rubberized side edges 22 and a rubberized bottom edge 23. The removable center divider 21 slides within the container's vertical center side track channel 26 and the vertical track 20 of the removable horizontal divider 17 when further separation of compartments is desired.

Still referring to FIG. 1, the preferred order of compartmentalization is to engage the horizontal removable divider 17 prior to engaging the removable center divider 21. FIG. 1 illustrates the fitting orientation of the horizontal removable divider 17, wherein rubberized edges 18 19 slide into the horizontal track channels 25 27. FIG. 1. Illustrates the fitting orientation of the center vertical removable divider 21, wherein the rubberized edges 22 slide into the vertical center side track channel 26 and the rubberized edge 23 slides into the bottom center track channel 24.

In the preferred embodiment of the present invention, the container 10, and all tracks 24 25 26 27 are formed from a single piece of molded plastic. The preferred embodiment of the present invention calls for the horizontal removable divider 17 and center removable divider 21 to be formed of molded plastic as well, with the edges 18 19 22 23 formed from silicone, which is bonded to the dividers 17 21. Alternative embodiments of the present invention allow for construction of different materials, such as glass, Pyrex or metal, and utilizing differing forming techniques.

Figure 2:
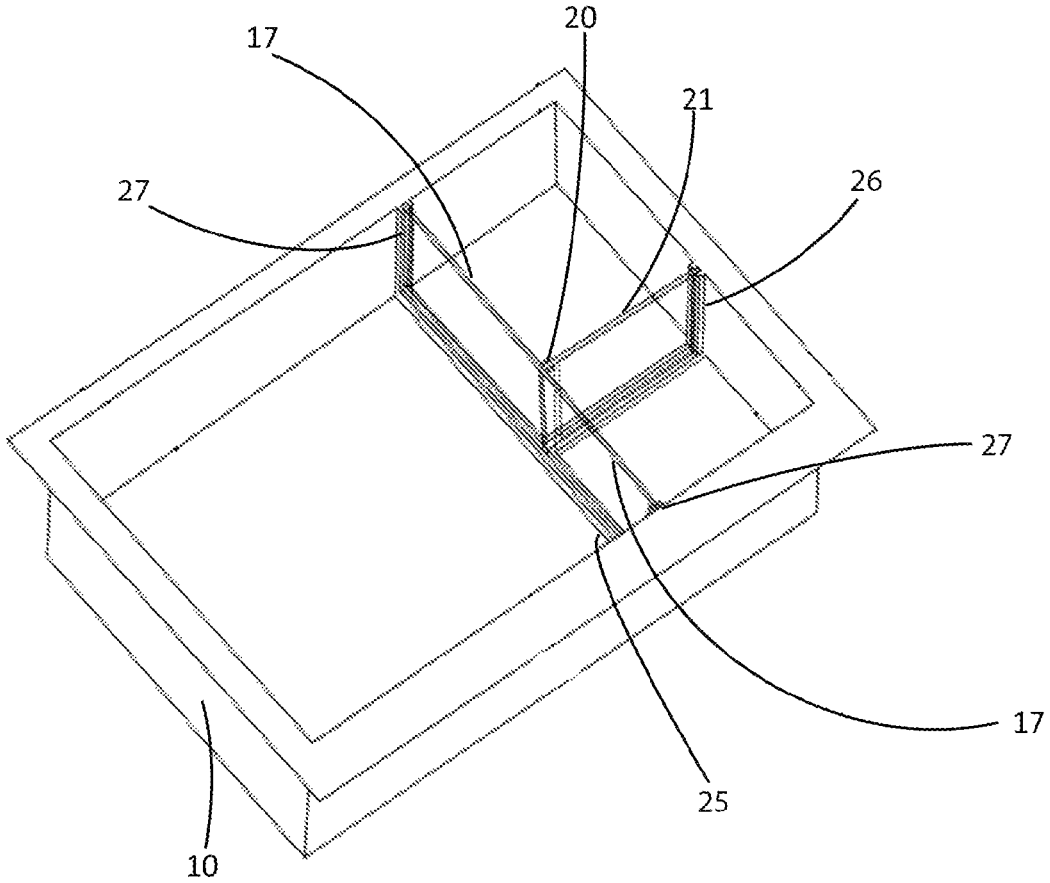
FIG. 2 is a perspective view of the present invention with the removable dividers placed in the tracks according to the preferred embodiment of the present invention.

FIG. 2 shows how the different components of the container 10 and removable dividers 17 21 work together to provide sealed compartments when the removable dividers 17 21 are coupled into the tracks 24 25 26 27. FIG. 2 shows the center vertical removable divider 21 perpendicular to the horizontal removable divider 17, and between the vertical side track channel 26 and the vertical track 20 of the horizontal removable divider 17.

Figure 3:
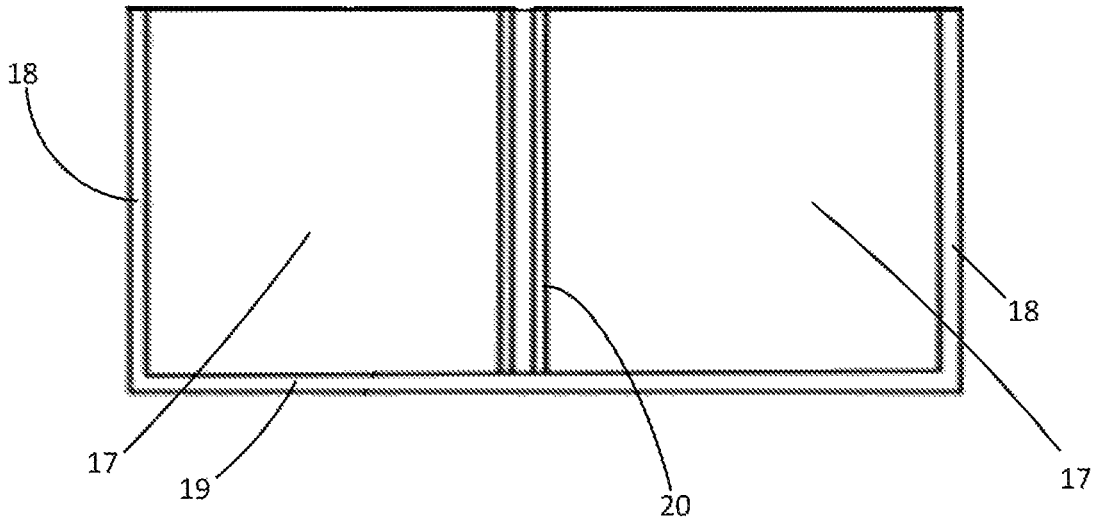
FIG. 3 is the individual side view of the horizontal removable divider according to the preferred embodiment of the present invention.

FIG. 3 shows the horizontal removable divider 17 apart from the preferred embodiment of the present invention. Seen in FIG. 3 are the horizontal removable divider 17, rubberized edges 18 19 and vertical track 20.

Figure 4:
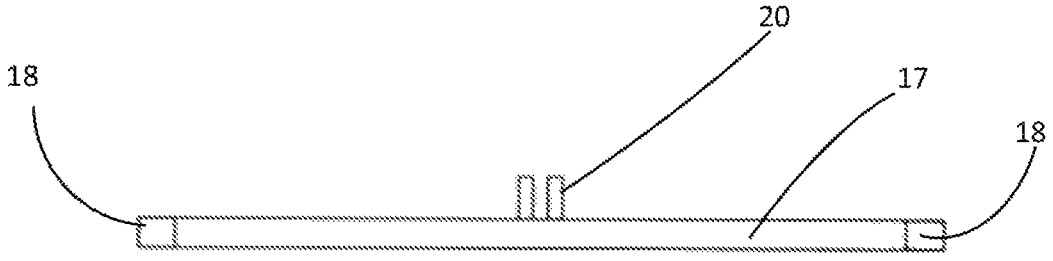
FIG. 4 is an individual top view of the horizontal removable divider according to the preferred embodiment of the present invention.

FIG. 4 shows an alternative view of the horizontal removal divider 17 apart from the preferred embodiment of the present invention and from above and demonstrates the rubberized edges 18 and vertical track 20.

Figure 5:
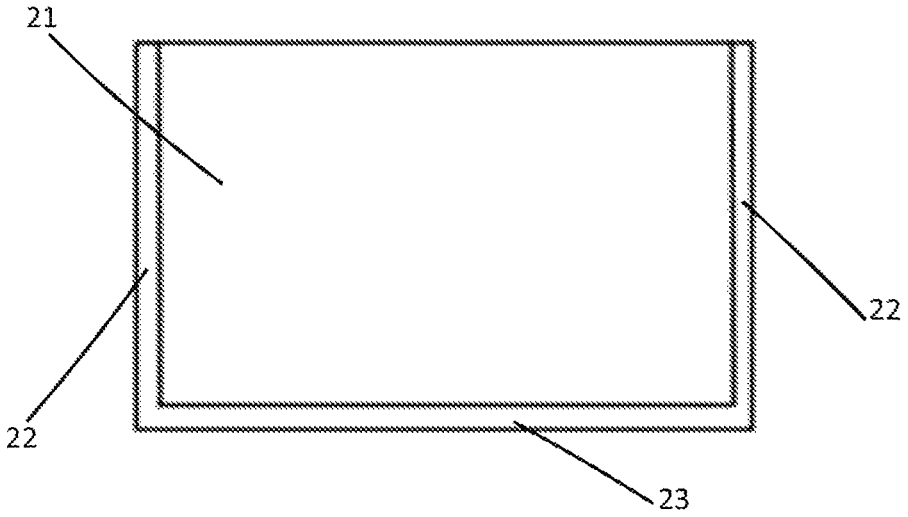
FIG. 5 is an individual side view of the removable center vertical divider according to the preferred embodiment of the present invention.

FIG. 5 shows the removable center vertical divider 21 with rubberized edges 22 and 23.

Figure 6:
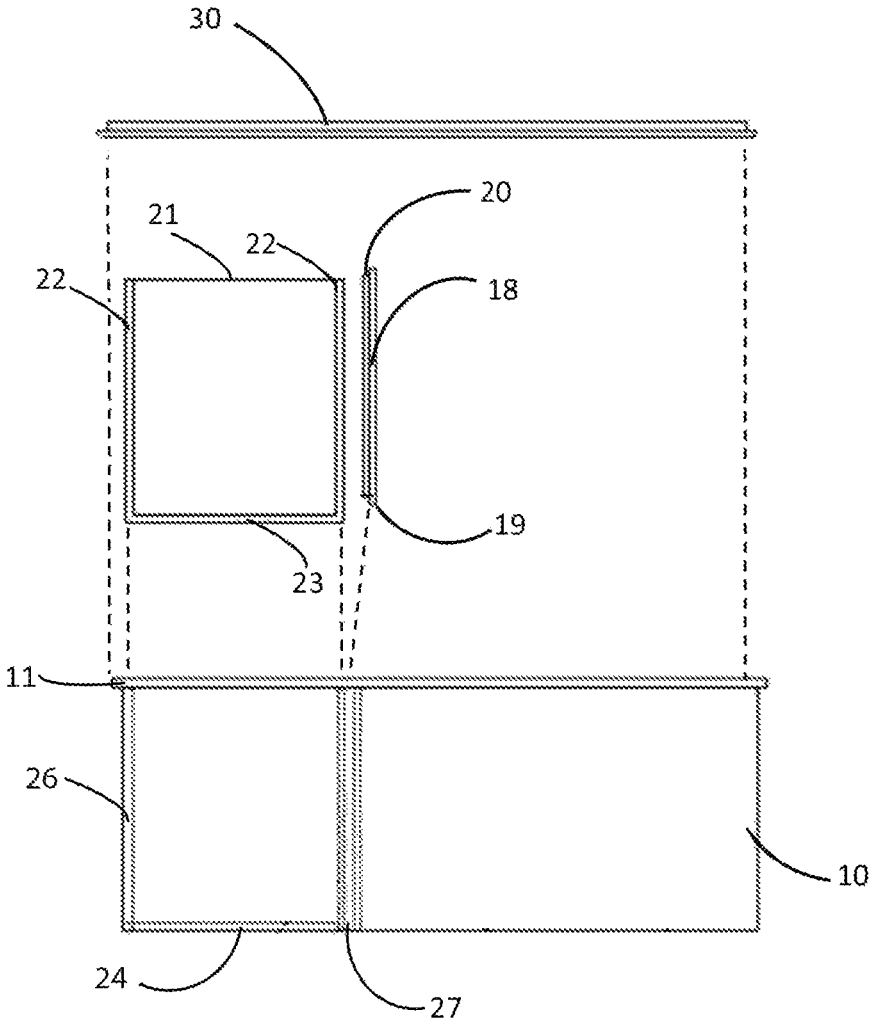
FIG. 6 is a side view of the container, demonstrating the orientation of the horizontal and vertical dividers, their insertion points within the tracks and the lid of the preferred embodiment of the present invention.

FIG. 6 is a side view of the container assembly 10, showing the rubberized edges 18 19 and vertical track 20 of the horizontal removable divider 17. FIG. 6 shows the position of the rubberized edges 18 19 of the horizontal removable divider 17, in relation to the tracks of the container 25 27. The lid 30 snaps securely in place onto the lip 11 of the container 10. FIG. 6 shows the position of the rubberized edges 22 23 of the removable center vertical divider 21 as they fit within the container 10.

FIG. 6 depicts the orientation of one end of the horizontal removable divider 17 into the side track channel 27 and the orientation of the fitting of the perpendicular, vertical center removable divider 21 wherein the edges 22 fit respectively into the vertical center track channel 26 and into the center track 20 of the horizontal removable divider 17. FIG. 6 further depicts lid 30 and its orientation with the lip 11 of the container 10.

Figure 7:
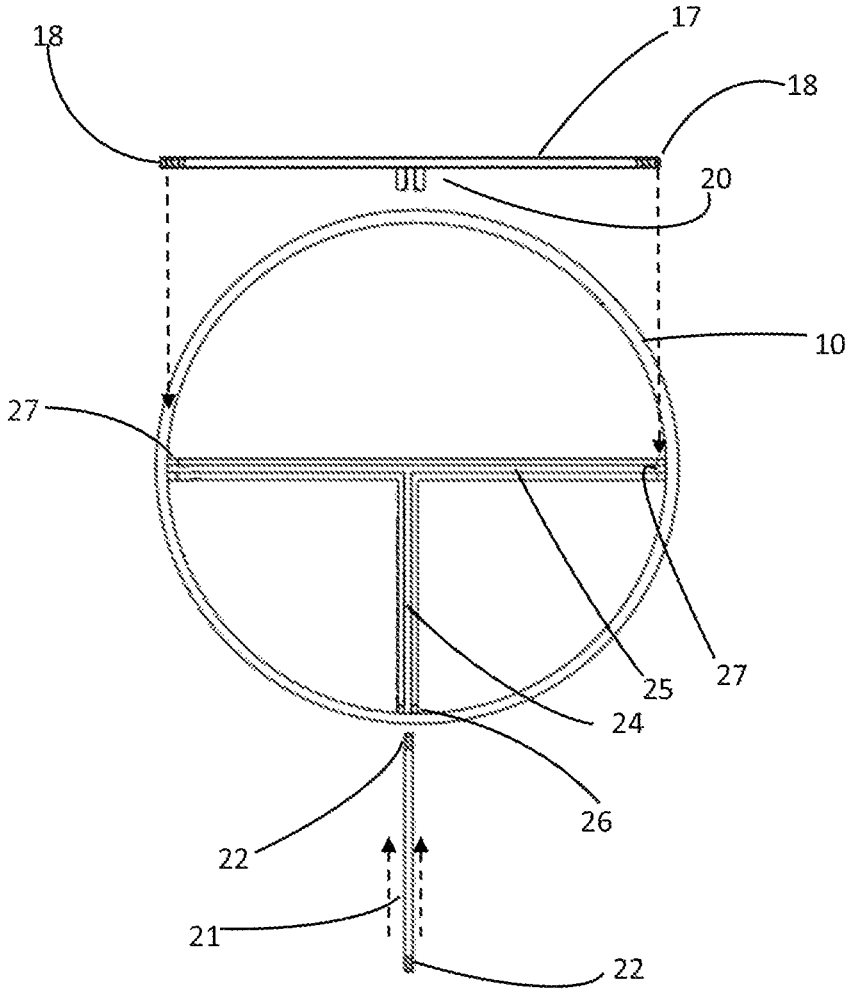
FIG. 7 is an aerial view of an alternative embodiment of the present invention showing the removable dividers and their insertion points in the tracks.

FIG. 7 is an aerial view of an alternative embodiment of the present invention. FIG. 7 shows a circular container 10, horizontal wall channel 27, horizontal bottom channel 25, bottom center channel 24 and a vertical center wall channel 26. FIG. 7 also shows, in removed position, a removable divider 17 having rubberized edges 18, and a center track 20. FIG. 7 also shows, in removed position, a center vertical removable divider 21 having rubberized edges 22. FIG. 7 illustrates the orientation of engagement of the components of this embodiment.

Figure 8:
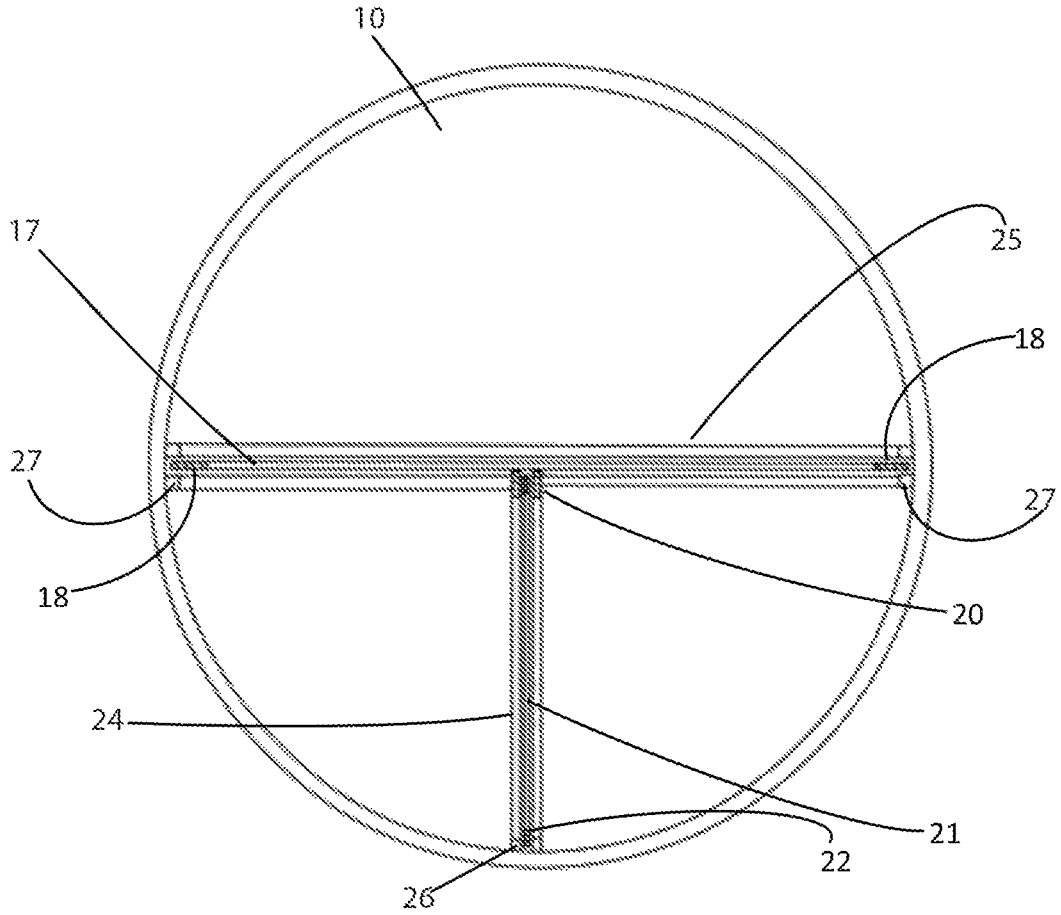
FIG. 8 is an aerial view of an alternative embodiment of the present invention with the removable dividers placed in the tracks.

FIG. 8 is an aerial view of the container according to the alternative embodiment of the present invention from FIG. 7. FIG. 8 shows horizontal wall channels 27, a horizontal bottom channel 25, a vertical bottom channel 26, and the center bottom channel 24. The horizontal removable divider 17 with a center track 20 and corresponding rubberized edges 18 is shown inserted within the channels 24 25 26 27.

While particular embodiments have been shown and described, the above variations are for illustrative purposes. It will be apparent to those skilled in this art that a plurality of equivalent variations, changes, combinations to the idea of and without departing from the disclosing and explanation of this invention and its broader aspects shall also fall within the technical scope of the appended claims and encompass all such changes within the true spirit and scope of this invention. Therefore, it is to be understood that the invention is solely defined by the appended claims. It will be understood by those skilled in this art that, in general, terms used herein, particularly appended claims (e.g. bodies of the appended claims) are generally intended as "open" terms (e.g. the term "including" is to be interpreted as "including but not limited to", the term "comprising" is not to be interpreted as limiting, the term 'having" is not to be interpreted as "having only".

Any elements described herein as singular can be pluralized, and plural elements can be used in the singular. The above-described elements, assemblies and methods, elements for carrying out the invention, and variations of aspects of the invention can be modified such as dimensions, volumes, shapes, sizes, method of manufacturing, in a plurality of different ways and type of utility.

What is claimed is:

1. A durable and reusable container for storage, comprising:

a flat bottom surface, said surface defining the length and width of the container;

side surfaces of equal height, said surfaces defining the depth of the container;

a removable lid providing a watertight seal around the side surfaces, said lid also acting as the top surface of the container;

two channels internal to the container, said channels running along the bottom and along one of the sides, the two channels perpendicular to each other; and at least one removable divider of suitable dimensions to fit flush with the dimensions of one of said internal channels.

2. A durable and reusable container for storage, comprising:

a flat bottom surface, said surface defining the length and width of the container;

side surfaces of equal height, said surfaces defining the depth of the container;

a removable lid providing a watertight seal around the side surfaces, said lid also acting as the top surface of the container;

at least one channel internal to the container, said channel running along the bottom and along at least one of the sides; and at least one removable divider of suitable dimensions to fit flush with the dimensions of an internal channel, any removable dividers featuring vertical channels to line flush with a corresponding channels on the bottom of the container.

3. The container of claim 2, wherein additional removable dividers fits flush within the channels formed by previously-inserted removable divider(s) and the bottom of the container.

* * * * *